US005282763A

United States Patent [19]

Dixon

[11] Patent Number: 5,282,763

[45] Date of Patent: Feb. 1, 1994

[54] STEERABLE BOW THRUSTER FOR SWATH VESSELS

[76] Inventor: John D. Dixon, 620 Solar Isle, Fort Lauderdale, Fla. 33301

[21] Appl. No.: 966,557

[22] Filed: Oct. 26, 1992

[51] Int. Cl.[5] ..... B63H 11/113

[52] U.S. Cl. ..... 440/42; 114/61; 114/114 B; 114/151

[58] Field of Search ..... 114/151, 61, 337, 338, 114/144 B; 440/38, 40, 41, 42, 43

[56] References Cited

U.S. PATENT DOCUMENTS

| | | | |
|---|---|---|---|
| 3,868,920 | 3/1975 | Schirtzinger | 114/151 |
| 4,345,533 | 8/1982 | Kunitake | 114/61 |
| 5,176,094 | 1/1993 | Gongwer | 114/61 |

FOREIGN PATENT DOCUMENTS

| | | | |
|---|---|---|---|
| 354402 | 2/1990 | European Pat. Off. | 114/151 |
| 3518883 | 10/1986 | Fed. Rep. of Germany | 114/151 |
| 3-281495 | 12/1991 | Japan | 114/151 |

*Primary Examiner*—Michael S. Huppert
*Assistant Examiner*—Thomas J. Brahan

[57] ABSTRACT

A steerable bow thruster (12) system is located substantially within the pontoons (20) of a semisubmerged vessel (10) exclusive of a rotating nozzle (42) which is located on the upper side of the pontoons. The rotating nozzle can turn in any direction and allows the steerable bow thruster system to thrust forward, aft and side to side and in any direction in between to allow the semisubmerged vessel to maneuver freely and without the assistance of the main engines. To minimize draft and to prevent ecological harm, the nozzles are installed on top of the pontoons allowing the pontoons to act as a barrier to keep thrust wash from disturbing shallow ocean bottoms and reefs over which the vessel may be operating. The propelling means may be shrouded to prevent harm or injury to swimmers who may be in the water. A rudder (44) may also be coupled to the thruster nozzle to provide directional control for the semisubmerged vessel when it is underway at higher speeds. The nozzle of the propelling means may be located forward of the center of lateral resistance of the semisubmerged vessel.

5 Claims, 2 Drawing Sheets

STEERABLE BOW THRUSTER FOR SWATH VESSELS

BACKGROUND

1. Field of the Invention

This invention relates to semisubmerged, small water plane area twin hull (swath) ships, specifically to steerable bow thrusters which draw seawater in from the sides of the pontoons, and discharge it from a steerable nozzle on the top of the pontoons. The nozzles are directional, and allow the swath to remain in one place without anchoring, also known as station-keeping.

2. Description of Prior Art

Small water plane area twin hull (swath) vessels, also called semisubmerged vessels, have been developed for improved motion, seakeeping and performance characteristics in high sea states. Many U.S. patents including U.S. Pat. No. 234,794 to Lundborg (1880), U.S. Pat. No. 3,063,397 to Boericke (1962), U.S. Pat. No. 3,623,444 to Lang (1971) and U.S. Pat. No. 4,174,671 to Seidl (1979) have been granted which disclose ships of this configuration.

Each of the configurations noted includes submerged pontoons that are parallel to each other and the design water line, vertical struts of reduced waterplane area, and an upper bridging deck. The above patents show a number of configurations for swath vessels.

Thruster systems have been developed for maneuvering and/or propelling a marine vessel by means of pump, tunnel prop, pipe and valve arrangements which take water in from the sea and discharge the water through outlets located in the boat hull so as to achieve the desired propulsive or turning effect. Such systems, as described for example, in U.S. Pat. Nos. 3,517,633, 4,056,073, and 4,214,544 typically employ pipes of various cross sections which curve or join other pipes or nozzles to form the water transport path. Thruster systems have also been developed which employ propellers of many types including screw, cycloidal or shrouded impellers on drive units that extend out of the vessel's hull as shown in U.S. Pat. Nos. 4,294,186 and 4,732,104.

All of these systems designed for conventional monohull vessels employ the bottom or side of the hull for locating the propulsive device. The swath hull form provides a new alternative that is superior for a number of reasons. The new alternative is to locate the propulsive device on the top side of the submerged pontoons. By locating the propulsive device on the top side of the submerged pontoons rather than on the bottom side, the draft of the vessel is minimized and damage to the propulsive device is eliminated in the event of grounding. In shallow water, the water on the top side of the pontoons is also likely to have less foreign matter that can foul or damage the propulsive device than the seawater on the bottom side of the pontoons due to its distance away from the sea bottom.

Conventional monohulls today employ rotatable propellers which extend downward from the bottom of the hull. Pursuant to the advancements disclosed in this patent an improvement of that system for swath vessels would be to invert the outdrive unit and attach it to the upper side of the submerged pontoon. Conventional monohulls today also employ tunnels with pumps or shrouded propellers which pull water in from the sides and discharge it out the bottom through a grating with louvered vents. The grating can be rotated to direct the thrust in approximately the desired direction. The direction is approximate because of the sharp change of direction the water must make through the relatively inefficient vents. Much of the thrust is spilled downward instead of aft, forward or athwartship. In accordance with the ideas advanced in this patent this system would also be improved for swath vessels by inverting the discharge and directing it out the top of the pontoon.

For a swath vessel operating in shallow draft areas, additional advantage is gained with respect to environmental impact. The environmental community has recognized the biological and ecological importance of the ocean bottom and the negative impact of sediment transport due to propeller wash. This is particularly relevant for vessels operating in and around shallow tropical reefs. Locating the propulsive device on top of the pontoons for swath vessels moves the propeller wash well away from the ocean bottom and even provides the pontoon itself as a barrier between the propeller wash and the ocean bottom greatly reducing and even eliminating the adverse environmental impact.

This advantage is even more apparent when one considers a vessel that is carrying snorkel and scuba divers to a shallow tropical reef. Such a vessel is discouraged from employing anchors due to the damage they will inflict on the fragile reef. Presently, permanent moorings are sometimes installed on reefs to allow vessels to visit, but they involve a substantial effort and expense to install and maintain. They are also of limited value to larger vessels due to the limited strength of the coral formations and coral substrate to which the moorings are attached.

The ideal solution for these vessels would be to not attach to the reef in any way whatsoever but rather station-keep above the reef. A vessel is station-keeping when it is maintaining a single location without mechanical attachment to the seafloor usually through the use of thrusters. Presently, many vessels without thrusters will drift with the wind and current for a period of time and then occasionally motor back to the area of the dive group. Ideally, the vessel would be under control at all times and either station-keep over one particular spot on the reef or slowly follow the dive group as it swims across the reef. For larger vessels, use of the main engines for this purpose is usually not satisfactory as the propeller wash would disturb the sediment on the ocean bottom reducing visibility. Any vessel using exposed propellers also endangers swimmers or divers in the water with the rotating propeller blades. Additionally, the use of the main propulsion engines to station-keep or maneuver the vessel with top speeds up to two knots would not be a very efficient use of engines that are designed to move the vessel at much greater speeds.

A conventional monohull with a rotatable bow thruster fitted to the bottom would station-keep but would still have the problem of propeller wash disturbing the sediment and reducing underwater visibility. Depending on the specific propulsive device utilized, rotating propellers may also pose a hazard to swimmers and divers. Pursuant to the ideas disclosed in this patent, a swath vessel with the propulsive device mounted on top of the pontoon would not at any time disturb the bottom sediments. By shrouding the propulsive device, danger for swimmers and divers would also be eliminated.

Mounting of the propulsion device on top of the pontoon rather than on the side has additional mechanical benefits. Top mounting of the propulsion device allows thrust in any horizontal direction by simply rotating the propulsive unit about a vertical axis. If the propulsive unit were installed on the side of the pontoon, the thrust would be limited to fore and aft direction with no athwartship capability unless additional range-of-motion capability were added to the propulsion device. Additional range-of-motion capability would inherently be more complex leading to additional hardware and sealing problems. Also, installation of a propulsion device on a side of a pontoon limits the thrust to only one side of the pontoon. On a two pontoon swath, a side installation would make only one of two thrusters available for athwartship movement.

The advancement described in this patent has additional features. Shrouding the propulsive device and ducting the thrust through piping provides the greatest level of safety for swimmers and divers. Seawater intake or suction drawn from the side of the pontoons will allow a swath vessel to maneuver even if it is temporarily ballasted up so that the upper side of the pontoons are clear of the water. Sea water intakes on the side and a rotating nozzle on top of the pontoon for the sea water discharge as opposed to a rotatable propeller will eliminate cavitation or emmersion of the propeller in a seaway.

OBJECTS AND ADVANTAGES

Several objects and advantages of the present invention are:

(a) to provide a semisubmerged swath vessel minimally comprised of a plurality of submerged pontoons parallel to each other and the surface of the water, a plurality of vertical struts of reduced water plane area and a plurality of bridge decks with a means for propelling the vessel where the propelling means is located on the upper-side of the submerged pontoons.

(b) to provide a semisubmerged swath vessel with a propelling means located on the upper side of the submerged pontoons where the propelling means is steerable through a range of directions.

(c) to provide a semisubmerged swath vessel with a propelling means located on the upper side of the submerged pontoons that is shrouded so as to preclude harm of injury to a swimmer in the water.

(d) to provide a semisubmerged swath vessel with a propelling means located on the upper side of the submerged pontoons where the propelling means draws suction from a plurality of inlets located on the sides of the submerged pontoons.

(e) to provide a semisubmerged swath vessel with a propelling means located on the upper side of the submerged pontoons where the propelling means is a nozzle which receives sea water flow from a device for propelling fluid located within the enclosed volume of the submerged pontoons.

(f) to provide a semisubmerged swath vessel with a propelling means located on the upper side of the submerged pontoons where the propelling means is a nozzle which receives sea water flow from a device for propelling fluid located within the enclosed volume of the pontoons and the intake for the seawater flow is located in the sides of the submerged pontoon.

Further objects and advantages are to provide a semisubmerged swath vessel with a propulsive means mounted to the top of the submerged pontoons which will be inexpensive to fabricate, easy to maintain and simple to operate. Still further objects and advantages will become apparent from a consideration of the ensuing description and drawings.

DRAWING FIGURES

Figure 1:
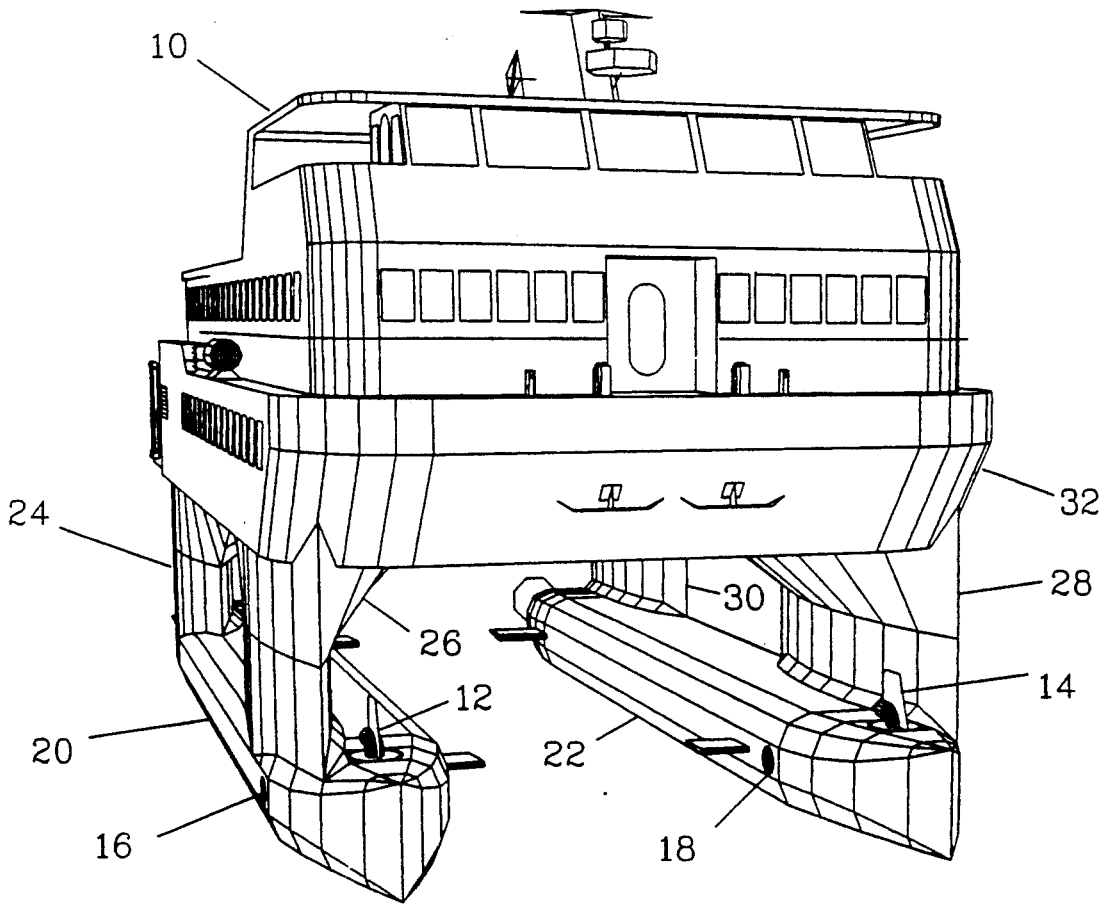
FIG. 1 is a perspective view of a swath vessel with the present invention incorporated.

| REFERENCE NUMERALS IN DRAWINGS | |
|---|---|
| 10 swath vessel | 12 starboard rotatable thruster |
| 14 port rotatable thruster | 16 starboard thruster intake outboard |
| 18 port thruster intake inboard | |
| 22 port pontoon | 20 starboard pontoon |
| 26 forward starboard strut | 24 aft starboard strut |
| 30 aft port strut | 28 forward port strut |
| 34 thruster intake tunnel | 32 bridge deck |
| 38 thruster pump motor | 36 thruster pump |
| 42 thrust nozzle | 40 thrust tunnel |
| 46 nozzle/rudder turntable | 44 rudder |
| 50 steering shaft | 48 steering shaft bracket |
| 54 steering shaft sprocket | 52 steering shaft stuffing tube |
| 58 steering motor sprocket | 56 steering chain |
| 62 steering motor | 60 steering motor shaft |
| 66 retaining ring | 64 hull plating |
| 70 bearing | 68 thrust collar |

DESCRIPTION-FIGS. 1 to 6

A semisubmerged small water plane area twin hull ship (swath) constructed in accordance with the preferred embodiment of the invention is illustrated in FIG. 1 and generally designated 10. Swath 10 includes two parallel submerged pontoons 20 and 22 which provide stability and buoyancy support for the upper bridge deck 32 through either two, or as depicted, four struts, 24, 26, 28 and 30.

Figure 2:
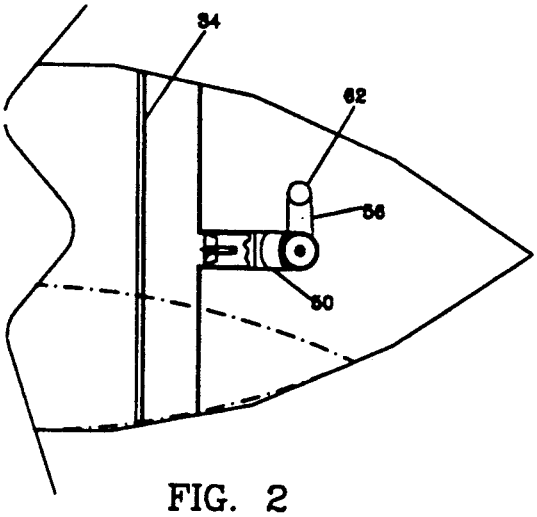
FIG. 2 is a top view of the steerable bow thruster through cross-section a—a as shown in FIG. 3.

Affixed to the top of pontoons 20 and 22 forward is the subject of the present invention, port and starboard rotatable thrusters, 12 and 14. FIG. 2 shows the thruster intake tunnel 34 running transversely athwartship. Two intakes 16 and 18 per thruster are incorporated in the preferred embodiment of the invention. The intakes 16 and 18 are oriented opposite each other on the inboard and outboard side of the pontoons. The opposing orientation of the thruster intakes 16 and 18 serves to cancel the effect a single intake might have on the motion of the vessel due to the mass movement of water into them.

Figure 3:
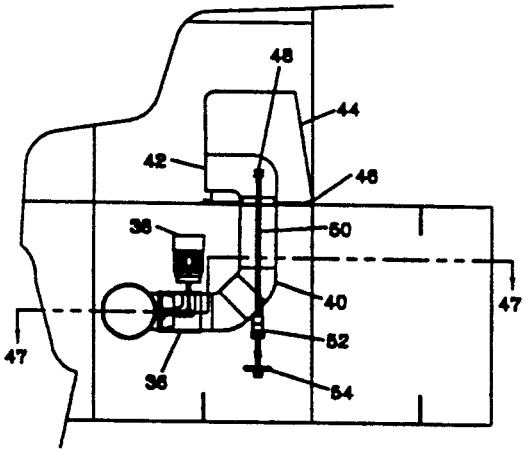
FIG. 3 is a cut-away side view of the steerable bow thruster.

FIG. 3 shows the thruster pump 36 which in the preferred embodiment utilizes an enclosed screw type impeller. Other variations of the thruster pump can be utilized including centrifugal, piston, diaphragm, etc. Coupled to the thruster pump is a thruster pump motor 38 that may be electric, hydraulic or even directly coupled to a fossil fuel type engine. A thrust tunnel 40 provides the water transport path from the thruster pump 36 to the thruster nozzle 42.

Attached to the thruster nozzle 42 is a rudder 44. Both the thruster nozzle 42 and rudder 44 are supported by the nozzle/rudder turntable 46. A steering shaft bracket 48 connects the thruster nozzle 42 and rudder 44 to the steering shaft 50. The steering shaft bracket 48 typically consists of two or three sections of flat bar aligned with the flow of the discharge water and attached to the inside of the thrust nozzle 42 on one end and attached to a steering shaft 50 on the other end. The steering shaft 50 runs vertically down the thrust tunnel 40 to a water tight stuffing tube 52. The steering shaft 50 exits the thrust tunnel 40 through the water tight stuffing tube 52 and terminates at the steering shaft sprocket 54.

Figure 4:
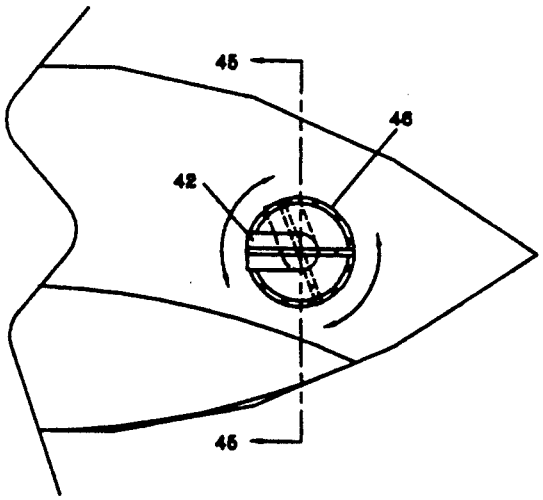
FIG. 4 is a plan view of the thruster nozzle and rudder installed on the thruster turntable.

FIG. 4 shows the thruster nozzle 42 and rudder 44 assembly mounted atop a nozzle/rudder turntable 46. The nozzle/rudder turntable 46 allows the nozzle 42 and rudder 44 to rotate in any direction through a full 360 degrees radius.

Figure 5:
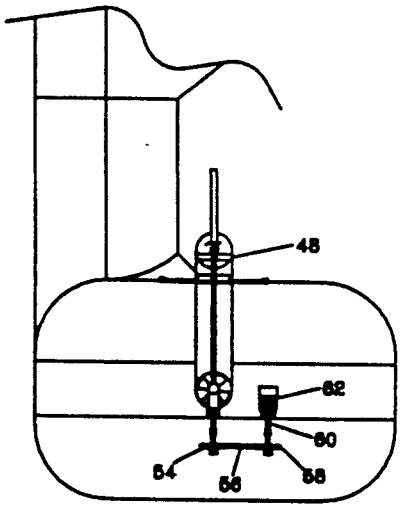
FIG. 5 is a cross-sectional view of the steerable bow thruster from the front through section b—b shown in FIG. 4.

FIG. 5 shows the steering chain 56 connecting the steering shaft sprocket 54 and the steering motor sprocket 58. The steering motor sprocket 58 is joined by the steering motor shaft 60 to the steering motor 62.

Figure 6:
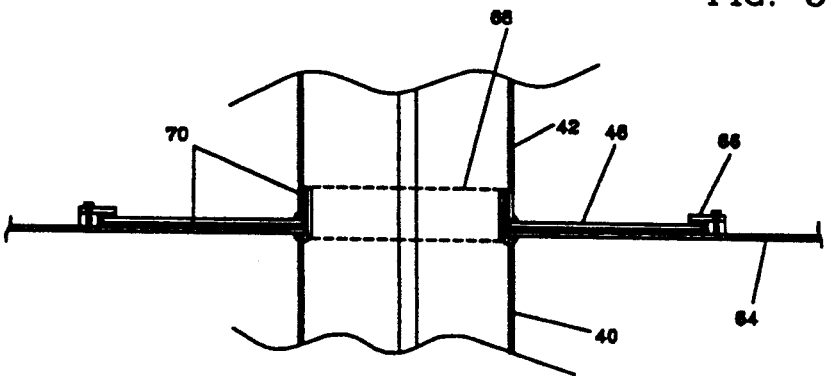
FIG. 6 is a detailed cross-sectional view of the turntable assembly as seen through section b—b shown in FIG. 4.

FIG. 6 provides additional detail on the nozzle/rudder turntable 46. The nozzle/rudder turntable is attached to the top side of the hull plating 64 and is held to the hull plating 64 by the retaining ring 66. A thrust collar 68 provides axial support for the nozzle/rudder turntable 46 to rotate about. Bearings 70 represented in FIG. 6 by hexagons are provided between the wear surfaces of the nozzle/rudder turntable 46 and the hull plating 64, the nozzle/rudder turntable 46 and the retaining ring 66, and, the thrust collar 68 and the thrust nozzle 42.

OPERATION-FIGS. 1 to 6

The manner of using the steerable bow thrusters varies depending on the speed of the vessel. At low speed the operation consists of energizing the thruster pump motor 38. The thruster pump motor 38 powers the thruster pump 36 which induces a suction on the intake side and a discharge on the nozzle side. In response to the suction, sea water moves in through the inboard and outboard intakes, 16 and 18, and down the thruster intake tunnel 34 to the intake side of the thruster pump 36. On the discharge side of the thruster pump 36 sea water moves from the thruster pump 36 through the thrust tunnel and out the thrust nozzle 42.

The specific maneuvering options at low speed are numerous and will likely be determined according to the designer and operator preferences. Both steerable bow thrusters could be controlled to thrust together in parallel or act individually. Acting individually without any other propulsion assistance the thrusters could be directed to oppose each other thus turning the vessel on its own axis. The thrusters could both be rotated aft to propel the vessel forward or rotated forward to propel the vessel rearward. Many other operational variations are possible.

At high speed the operation of the steerable bow thruster is through directional orientation of the rudder 44. The thruster pump 36 would be utilized for certain high speed operations such as emergency turns and operating with only one engine. Normally, the rudders 44 would be sized so that they alone effect course changes and hold the vessel on a stable course at normal cruising speeds.

For either low-speed or high-speed operation the orientation and direction of the thrust nozzle 42 and the rudder 44 are controlled. At low speeds the steering motor 62 can be energized to rotate the circular nozzle/rudder turntable 46 through a full 360 degrees. At higher speeds the nozzle/rudder turntable 46 would be limited to smaller angles of attack as determined by the stall speed of the rudder and the ultimate strength of the thrust nozzle 42, rudder 44 and thrust/rudder turntable 46 assembly.

Many variations of the invention can be incorporated according to designer and operator preferences. Numerous mechanical linkages exist for controlling the rotation of the thrust nozzle 42 and rudder 44. Structural weak points can also be incorporated that will allow the thrust nozzle 42 and rudder 44 to break-away without damaging the pontoons, 20 and 22, or the hull plating 64 in the event of collision with a submerged object. The options and specific design of thruster pumps 36 and thruster pump motors 38 are virtually without limit. Additionally, existing nozzle and tunnel technology nozzle to improve hydrodynamic flow can also be employed in the invention such as reducing the diameter of the thrust nozzle 42 towards the outlet end and installation of flow vanes within the thruster intake tunnel 34 and thrust tunnel 40.

SUMMARY, SPECIFICATION, AND SCOPE

The present invention provides a semisubmerged, small water plane area twin hull (swath) vessel with steerable bow thrusters which draw seawater in from the sides of the pontoons and discharge it from rotatable nozzles on the top of the pontoons. The directional nozzles allow the swath vessel to maintain position in one place without anchoring, also known as station-keeping.

While other devices may be used to implement the invention including alternative thrust devices, it is understood that such changes will be within the spirit and scope of the present invention, as is defined by the appended claims.

What is now claimed is:

1. A semi-submerged vessel, comprising;

a plurality of substantially parallel submerged pontoons each having an upper surface;

a plurality of vertical struts and a plurality of bridge decks connected to said vertical struts;

said submerged pontoons each having a propulsion means for maneuvering said vessel located substantially within said respective pontoon and including a rotating nozzle located on said upper surface of said pontoon, each of said nozzles capable of approximately 360 degrees of rotation, whereby said propulsion means are capable of thrusting forward, aft and to either side, and uses its respective submerged pontoon as a thrust wash barrier between its nozzle and the sea bottom.

2. The combination as set forth in claim 1 wherein a means for impelling seawater within said prepulsion means is shrouded to human contact whereby risk of harm or injury to a swimmer in the water is reduced.

3. The combination as set forth in claim 1 wherein said propulsion means draws suction from a plurality of inlets located on a plurality of sides of said pontoons whereby said vessel will benefit from operation of said propulsion means when said vessel is ballasted up into a catamaran mode for shoal water passage wherein said nozzle of said propelling means is raised out of the seawater.

4. The combination as set forth in claim 1 wherein said nozzle includes an integrally mounted rudder whereby steering control is augmented when said vessel is underway at higher speeds.

5. The combination as set forth in claim 1 wherein said nozzles of said propulsion means are located forward of the center of said vessel.

* * * * *